United States Patent [19]

Toyoda et al.

[11] Patent Number: 4,713,722

[45] Date of Patent: Dec. 15, 1987

[54] SUPERCONDUCTING SYSTEM AND METHOD FOR CONTROLLING THE SAME

[75] Inventors: Eiji Toyoda, Wako; Soichiro Hayashi, Hino, both of Japan

[73] Assignee: Kabushiki Kaisha Toshiba, Kawasaki, Japan

[21] Appl. No.: 886,315

[22] Filed: Jul. 17, 1986

[30] Foreign Application Priority Data

Jul. 20, 1985 [JP] Japan ..... 60-160847
Feb. 18, 1986 [JP] Japan ..... 61-31821

[51] Int. Cl.[4] ..... H01H 47/00
[52] U.S. Cl. ..... 361/141
[58] Field of Search ..... 361/141; 363/14; 323/360; 324/248; 331/107 S; 307/245

[56] References Cited

U.S. PATENT DOCUMENTS 3,848,162 11/1974 Ichikawa et al. ..... 361/141

*Primary Examiner*—L. T. Hix
*Assistant Examiner*—David Porterfield
*Attorney, Agent, or Firm*—Oblon, Fisher, Spivak, McClelland & Maier

[57] ABSTRACT

A superconducting system including a superconductive coil and a perpetual current switch connected in parallel therewith in a cryogenic vessel, wherein the perpetual current switch includes a superconductive lead and a heater that causes the superconductive lead to be normal-conductive; and a DC power source that can arbitrarily change the output thereof with respect to the superconductive coil and the perpetual current switch. The system circulates a current of a specified amount within a closed loop constituted by the superconductive coil and the superconductive lead so as to create a perpetual current loop. The system further includes a reference generator unit provided with a current reference value that has a first sweep gradient and changes the superconductive coil current, an established current value such that the superconductive coil current is caused to reach a specified target value, a current reference value that has a second sweep gradient and does not change the superconductive coil current after the arrival thereof at the target value but changes currents that respectively flow into the DC power source and the superconductive lead; and a timing control unit that switches with specified changeover timings the two current reference values and the heater-energizing periods.

16 Claims, 12 Drawing Figures

SUPERCONDUCTING SYSTEM AND METHOD FOR CONTROLLING THE SAME

BACKGROUND OF THE INVENTION

1. Field of the Invention

This invention relates to a superconducting system for creating a superconducting perpetual current loop for use in a nuclear magnetic resonance medical diagnosis apparatus (NMR-CT) or a power storage magnet that converts power into magnetic energy and stores the same.

2. Discussion of Background

FIG. 6 is a schematic diagram illustrating a conventional superconducting system that creates a perpetual current loop. The conventional superconducting system is constituted by a power source 2 for a superconductive coil 1 (hereinafter simply referred to as a DC power source) that supplies power to excite the superconductive coil 1, a perpetual current switch 3 connected in parallel with the superconductive coil 1 so as to create a perpetual current loop together with the superconductive coil 1, a heater 5 that heats a superconductive lead 4 incorporated within the perpetual current switch 3, a heater power source 6 that supplies power to the heater 5, a DC circuit breaker 7 that interrupts the power being supplied from the DC power source 2 to the superconductive coil 1 upon occurrence of abnormalities, and a protective resistor 8 that when the DC circuit breaker 7 is opened, consumes magnetic energy stored in the superconductive coil 1 so as to protect the superconductive coil 1. The superconductive coil 1 and the perpetual current switch 3 are incorporated within a cryogenic vessel (cryostat) 9 in order to realize a superconductive state. A shunt resistor 10 is used as a current detector to detect a current from the DC power source 2 in a constant current control state, and the thus detected power source current $I_1$ is fed through an amplifier 11 into an adder 12.

The perpetual current switch 3 is constituted by the superconductive lead 4 and the heater 5, and functions such that when the heater power source 6 does not energize the heater 5, the superconductive lead 4 is refrigerated by liquid helium (LHe) (not shown) within the cryogenic vessel 9 to a temperature below the critical temperature Tc and becomes superconductive. When the heater power source 6 energizes the heater 5, the superconductive lead 4 is heated to a temperature above the critical temperature Tc so as to become normal-conductive, i.e., to possess a resistance value of R which is an electrically constant finite value.

FIG. 7 illustrates, with regard to the above-described configuration, the operation to create a perpetual current loop.

It is now assumed that both the superconductive coil 1 and the perpetual current switch 3 incorporated within the cryogenic vessel 9 have already been in a superconductive state and the DC power source 2 does not produce any voltage or current. In this state, when a current is fed into the superconductive coil 1, first, the heater power source 6 is turned on at a time $T_1$, and this causes the heater 5 to heat the superconductive lead 4 within the perpetual current switch 3 so that the superconductive lead 4 becomes normal-conductive so as to possess the resistance value of R.

Next, at a time $T_2$ the DC power source 2 is caused to start up and to produce voltage and current so as to energize the superconductive coil 1. At this instant, should a large current be abruptly supplied to the superconductive coil 1, a quenching is developed and the superconductive state thereof cannot be maintained, so that the DC power source 2 is controlled such that a current $I_3$ to be fed into the superconductive coil 1 is gradually raised at a certain limited change rate. For this reason, a reference value $I_{ref}$ is fed into the adder 12 so that a power source current $I_1$ of the DC power source 2 is changed from 0 to an ultimate target current value $I_O$ at a specified change rate. Namely, the DC power source 2 is operated in accordance with a difference $\epsilon$ between the reference value $I_{ref}$ and a detected current value (a feedback value) derived through an amplifier 11 from a shunt resistor 10 so as to control the power source current $I_1$ which is fed into the superconductive current loop within the cryogenic vessel 9. This allows the power source current $I_1$ to gradually increase from 0 to $I_O$ at a constant change rate according to the reference value $I_{ref}$. During the period of this increase, the DC power source 2 generates a small constant voltage V, and in accordance with this voltage V, a small constant current $I_2$ is fed into the superconductive lead 4. Therefore, into the superconductive coil 1, is fed the current $I_3$ ($I_3=I_1-I_2$) obtained by subtracting the small constant current $I_2$ from the power source current $I_1$ as shown in FIG. 7.

When the power source current $I_1$ finally reaches, after continuously gradually increasing, the ultimate target current value $I_O$, the output voltage V of the DC power source 2 becomes substantially zero because the difference $\epsilon$ becomes zero. This causes the current $I_2$ which has been flowing through the superconductive lead 4 to decrease in accordance with a time constant ($\tau=L/R$) determined by the resistance R of the superconductive lead 4 and the inductance L of the superconductive coil 1, and to become zero. Therefore, at this instant, the current $I_3$ that flows through the superconductive coil 1 becomes equal to the power source current $I_1$, i.e., to the ultimate target current value $I_O$ ($I_1=I_3=I_O$).

Next, in this state, should the heater power source 6 be turned off at a time $T_3$, the superconductive lead 4 is refrigerated by the liquid helium so as to become superconductive and to possess a resistance value of zero. After a time $T_4$ at which the superconductive lead 4 possesses a resistance value of zero, the power source current $I_1$ that flows into the DC power source 2 is gradually decreased. This decrease of the power source current $I_1$ is fed into the superconductive lead 4 as a reverse-flow current $I_2$. Namely, after the time $T_4$, the superconductive coil current $I_3$ does not change but flows separating into the power source current $I_1$ and the superconductive lead current $I_2$. As a result, a gradual decrease of the current $I_1$ causes a gradual increase of the current $I_2$ in a direction opposite to the arrow shown in FIG. 6. However, even in this case, there also exists a danger such that should the power source current $I_1$ be abruptly decreased, the superconductive lead current $I_2$ is caused to abruptly increase, whereby the superconductive lead 4 is returned to the normal-conductive state. Thus, there is performed a current control such that the power source current $I_1$ is gradually lowered in accordance with the reference value $I_{ref}$ as shown in the dotted line in FIG. 7.

As a result, the power source current $I_1$ becomes completely zero at a time $T_5$, so that there can be obtained the superconducting perpetual current loop that circulates a perpetual current of $I_3=I_2=I_0$ separated from the DC power source 2.

In a conventional medical diagnosis apparatus (NMR-CT) that employs a superconducting system, the nucleus to be imaged has been only one proton (i.e., the nucleus of hydrogen), and the apparatus has been generally of a type that is fixedly installed within a hospital's diagnosis room. There generally therefore has been no problem even when the strength of a generated magnetic field of the aforementioned superconductive coil 1 is maintained constant. Furthermore, the superconductive perpetual current loop generally has been maintained for a long period of time in which the diagnoses of a large number of patients has been successively made. In other words, frequent changes of the strength of the generated magnetic field of the superconducting system have generally not be necessitated.

However, in recent diagnostic apparata, besides a single proton, many other nuclei such as fluorine (F), sodium (Na) and phosphorus (P), for example, are required to be imaged so that more accurate diagnosis can be made. To realize this requirement, there should be created appropriate magnetic fields of strengths suitable for the nuclear magnetic resonance frequencies of the respective nuclei to be imaged. Naturally, the required magnetic field strength differs depending on the respective nuclei to be imaged, so that in order to obtain the imagery of the different nuclei, it is necessary to change the strength of the generated magnetic field of the superconducting system upon request.

Moreover, recently there is being studied a MRI diagnosis vehicle (nuclear magnetic resonance type medical diagnosis vehicle), which is large-size trailer on which the above-described medical diagnosis apparatus that includes the superconducting system is installed. This vehicle is mobile and goes to various places for the purpose of medical diagnosis. In this case, when moving from one place to another, the strength of the generated magnetic field of the superconducting system operated in the perpetual current loop state should be decreased to zero or extremely weakened. This is because the generated magnetic field for diagnosis has such a strength of 0.3−2.0 tesla (1 tesla=10,000 gauss) that the trailer cannot be relocated in view of the attendant danger to do so. Therefore, also in the case of MRI diagnosis vehicles it is necessary frequently to change the strength of the generated magnetic field of the superconducting system.

However, in the conventional method for controlling superconducting system, as shown in FIG. 7, the sweep gradient with which the DC power source 2 raises the current $I_3$ of the superconductive coil 1 is disadvantageously identical to the sweep gradient with which the power source current $I_1$ is lowered after the perpetual current loop is once obtained, so that a period from the time at which the specified perpetual current loop is obtained to the time at which the DC power source 2 is turned off becomes extremely long. When this disadvantage is considered in regard to the case of the aforementioned medical diagnosis apparatus (NMR−CT), there can be a case in which a series of the control time reaches several hours or even more. During this control time, naturally the diagnosis of the patient cannot be performed, and during this down time original diagnosis functions cannot be exhibited. This is a crucial disadvantage resulting in diagnostic inefficiency, and improvement thereof has been required.

Further, as shown in FIG. 7, during the period in which the current $I_3$ of the superconductive coil 1 is raised by use of the DC power source 2, the heater power source 6 is maintained in the ON state so as to continue the state of heating the heater 5. This causes the inside of the cryogenic vessel 9 to be unnecessarily heated, so that expensive liquid helium, the refrigerant, is unnecessarily evaporated, disadvantageously limiting the useful life of the device in the system as well as having an adverse economical impact.

SUMMARY OF THE INVENTION

Accordingly, one object of the present invention is to provide a method for controlling a superconducting system such that a series of control periods from the time at which a specified perpetual current loop is obtained to the time at which a DC power source is turned off can be minimized without either raising the ratings of the DC power source or taking measures to change the structure of the superconductive coil in order to enhance the current change rate, either of which entails an increase of manufacturing cost, whereby diagnostic efficiency can be enhanced.

Another object of this invention is to provide an economical and highly reliable superconducting system that minimizes the evaporation of expensive liquid helium and increases the useful life of the device in the system.

Another object of this invention is to provide a superconducting system capable of obtaining the imagery of many different nuclei by changing the strengths of the generated magnetic field of the superconducting system.

These and other objects are achieved according to the present invention by providing a new and improved superconducting system having a superconductive coil, a perpetual current switch that is connected in parallel therewith and includes a superconductive lead and a heater that causes the superconductive lead to be normally conductive, both of which are incorporated within a cryogenic vessel, and a DC power source that can arbitrarily change the output thereof with respect to the superconductive coil and the perpetual current switch, wherein the system circulates a current of a specified amount within a closed loop constituted by the superconductive coil and the superconductive lead so as to create a perpetual current loop. The system includes a reference generator unit provided with a current reference value that has a first sweep gradient and changes the superconductive coil current, an established current value such that the superconductive coil current is caused to reach a specified target value, a current reference value that has a second sweep gradient and does not change the superconductive coil current after the arrival thereof at the target value but changes currents that respectively flow into the DC power source and the superconductive lead, and a timing control unit that switches with specified changeover timings the two current reference values and the heater-energizing period. According to the system of the invention, the absolute value of the second sweep gradient is determined to be greater than the absolute value of the first sweep gradient.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
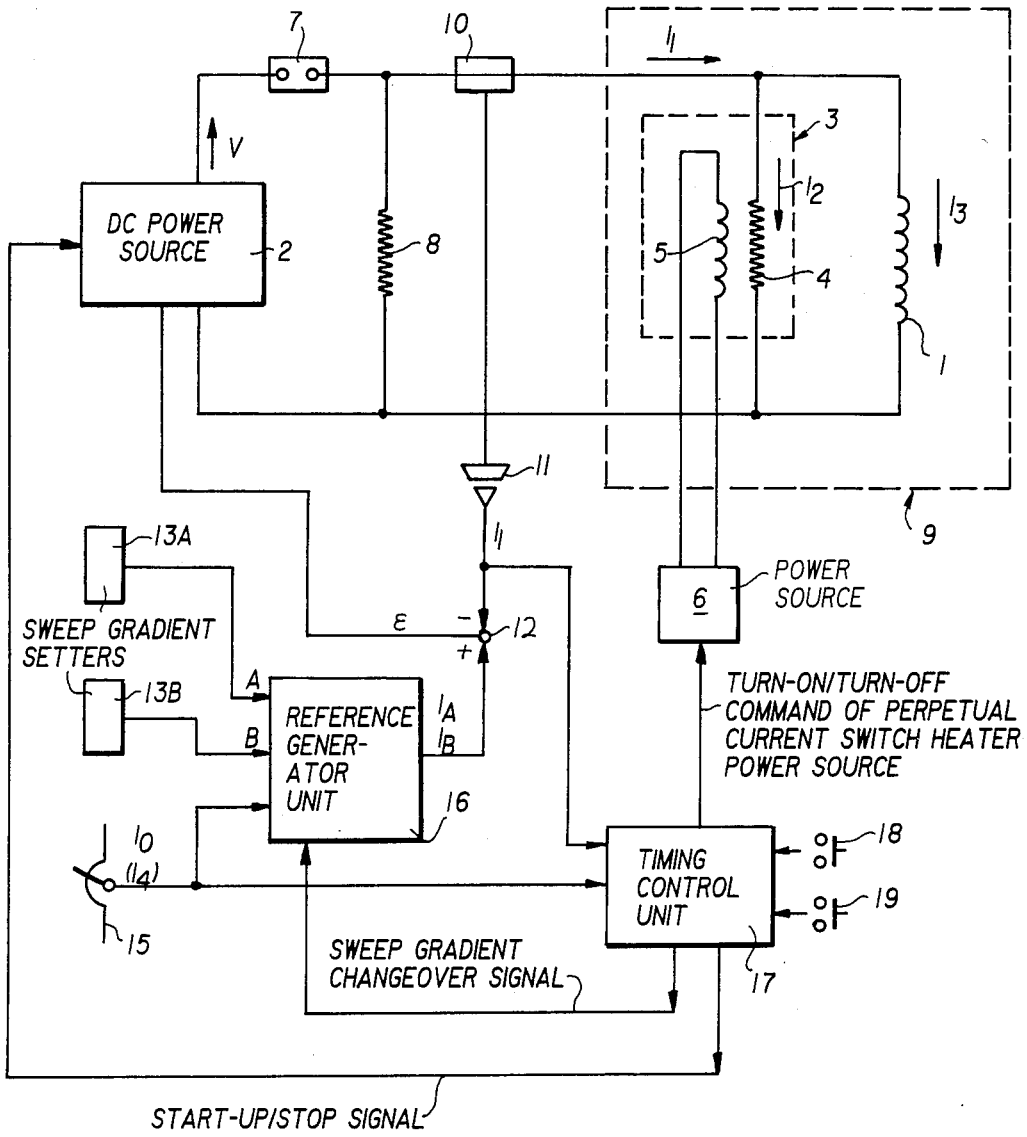
FIG. 1 is a schematic diagram illustrating a configuration of one embodiment of the system according to the present invention.

Referring now to the drawings, wherein like reference numerals designate identical or corresponding parts throughout the several views, and more particularly to FIG. 1 thereof, one embodiment of the present invention will be described. FIG. 1 is a diagram illustrating a schematic configuration of a superconducting system according to one embodiment of the present invention. In FIG. 1, this configuration differs in that there are additionally provided sweep gradient setters 13A and 13B, a target current setter 15, a reference generator unit 16, a timing control unit 17 an operation command switch 18, and an operation mode changeover switch 19.

The setter 13A establishes a sweep gradient A that is used in the case where a superconductive coil current $I_3$ is changed. The setter 13B establishes a sweep gradient B that is used in the case where only a power source current $I_1$ and a superconductive lead current $I_2$ are changed while the superconductive coil current $I_3$ is not changed. The target current setter 15 establishes a target current $I_0$ in the same manner as in the case of the conventional superconducting system. The reference generator unit 16 receives the target current $I_0$ established by the target current setter 15 and the sweep gradient A established by the sweep gradient setter 13A or the sweep gradient B established by the sweep gradient setter 13B so as to produce a current reference $I_A$ or a current reference $I_B$ that changes in accordance with the sweep gradient A or the sweep gradient B until the power source current $I_1$ reaches the target current $I_0$ or a value of zero. The timing control unit 17 receives the power source current $I_1$ and the target current $I_0$ and compares the received signals with each other so as to produce changeover timings of turn-on and turn-off of the heater power source 6 and the current reference $I_A$ or the current reference $I_B$.

Figure 2A:
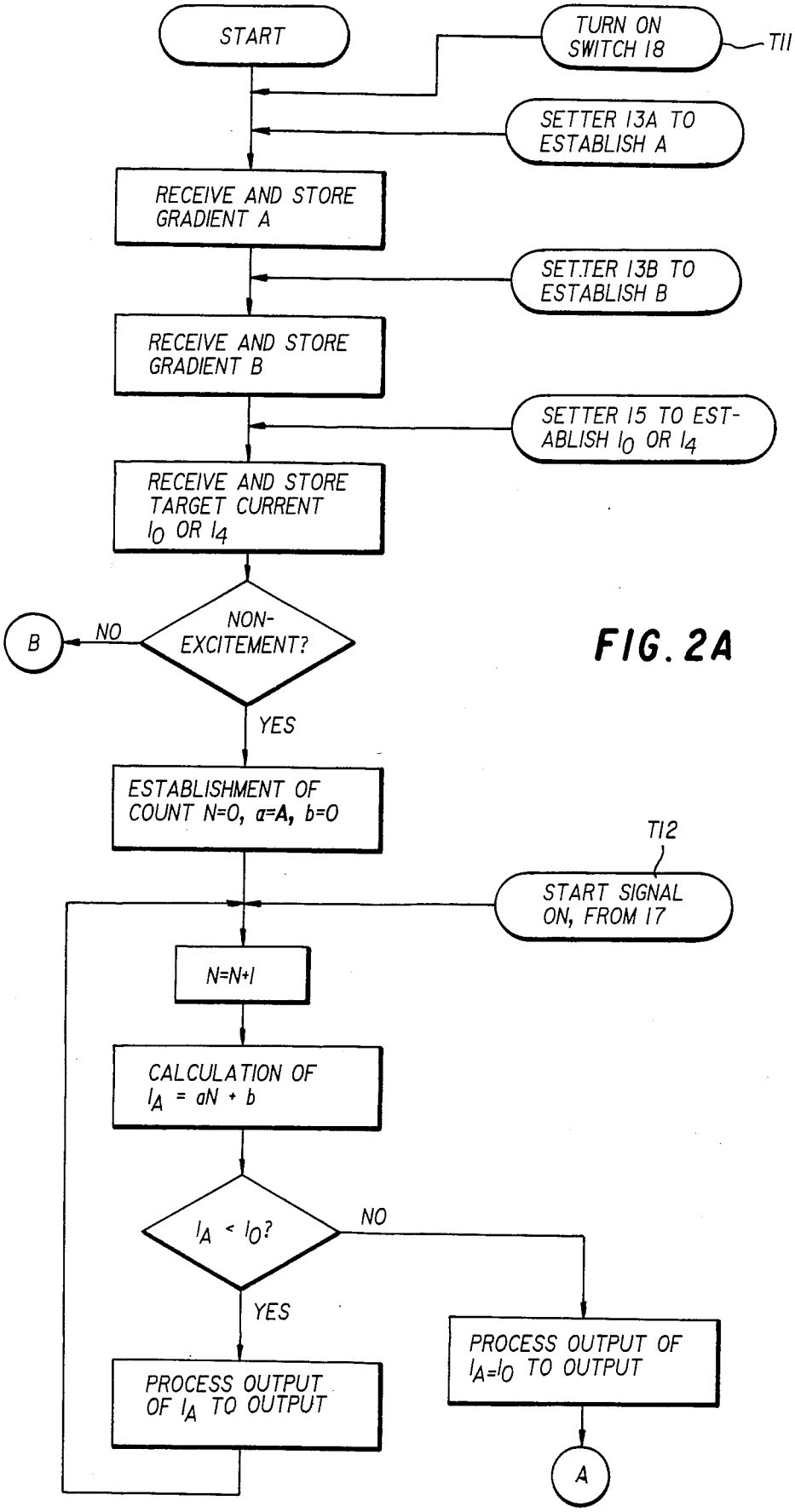
FIG. 2(A), 2(B) and 2(C) are detailed control flow charts of a reference generator 16 according to the present invention.
Figure 2B:
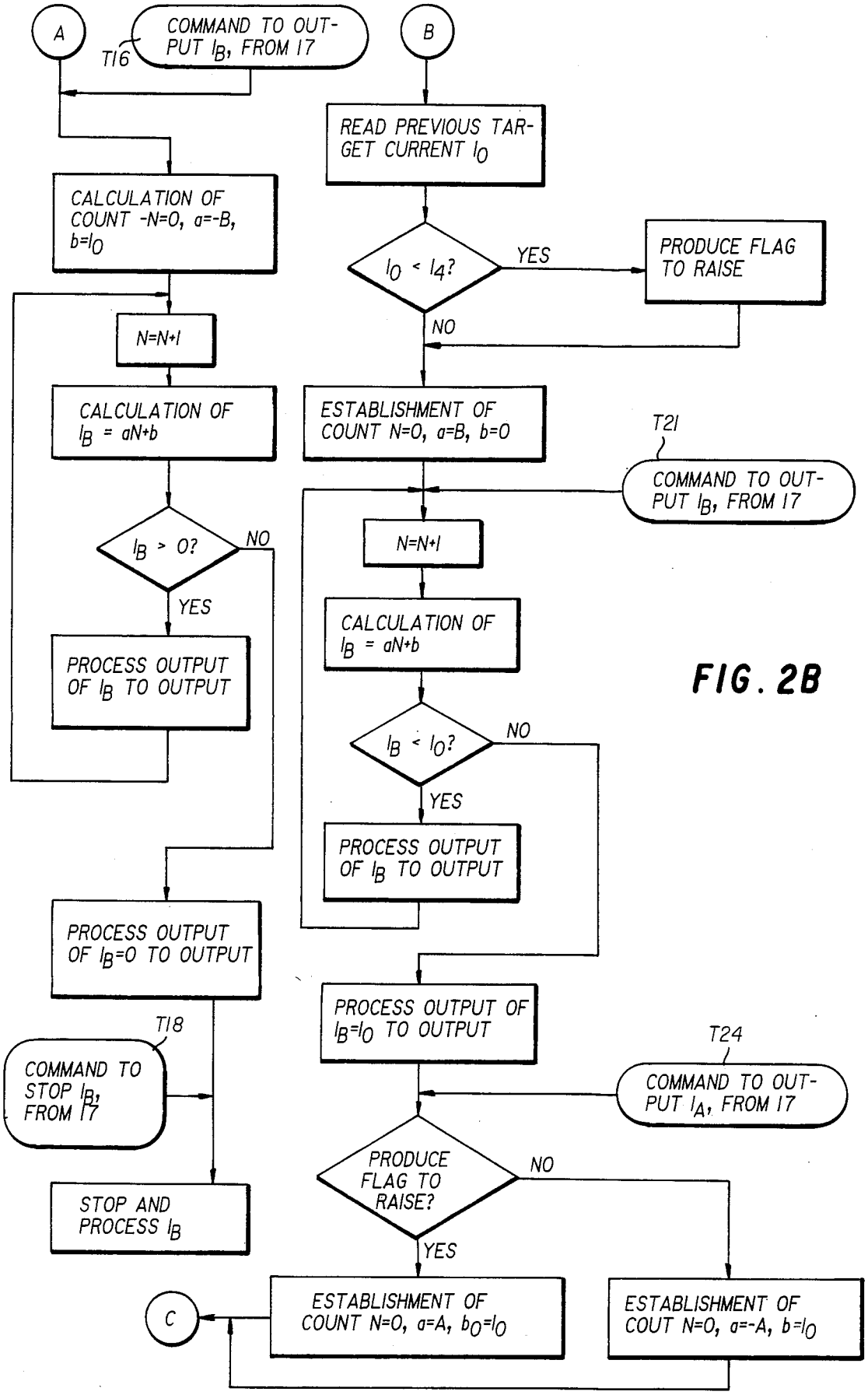
Figure 2C:
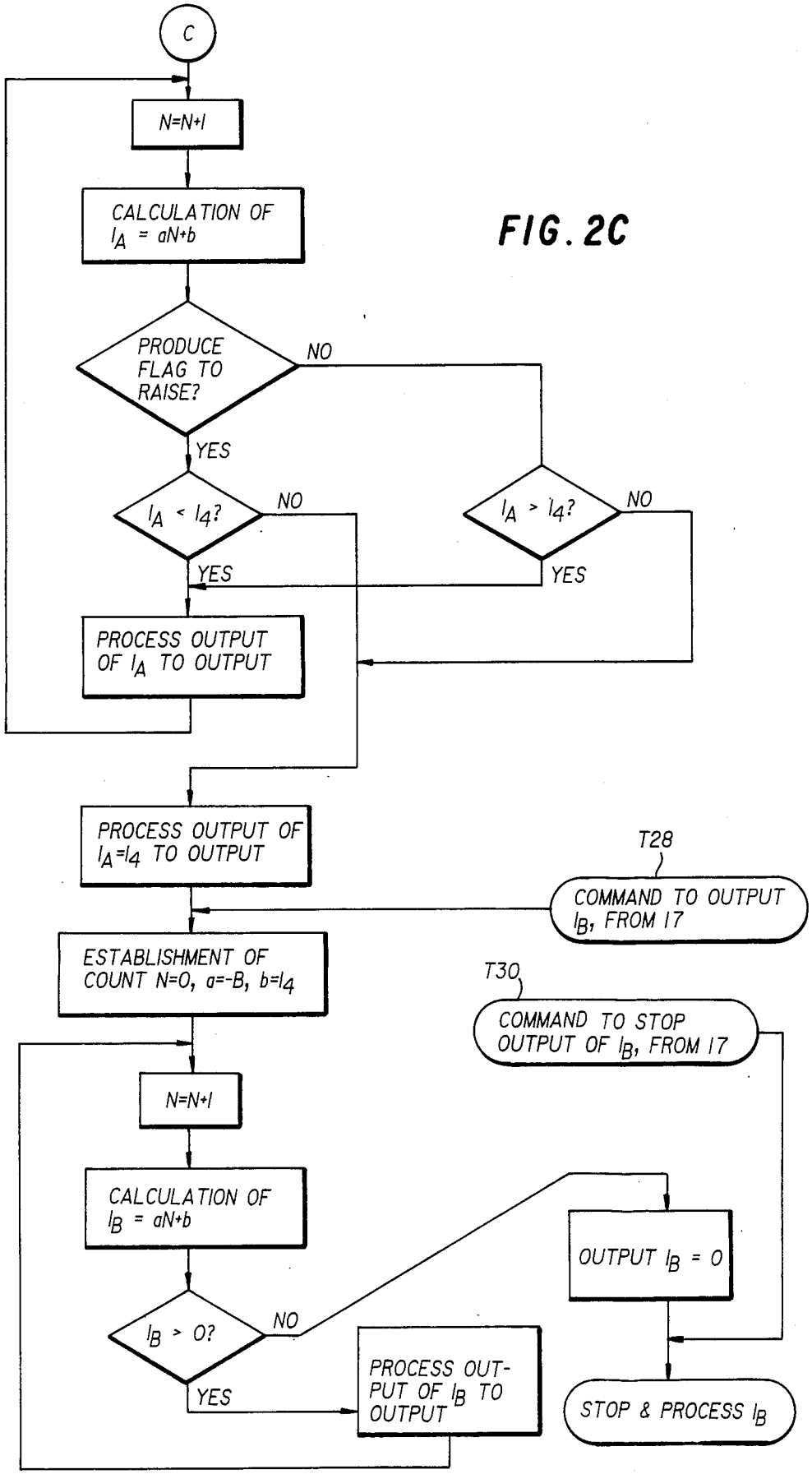
Figure 2D:
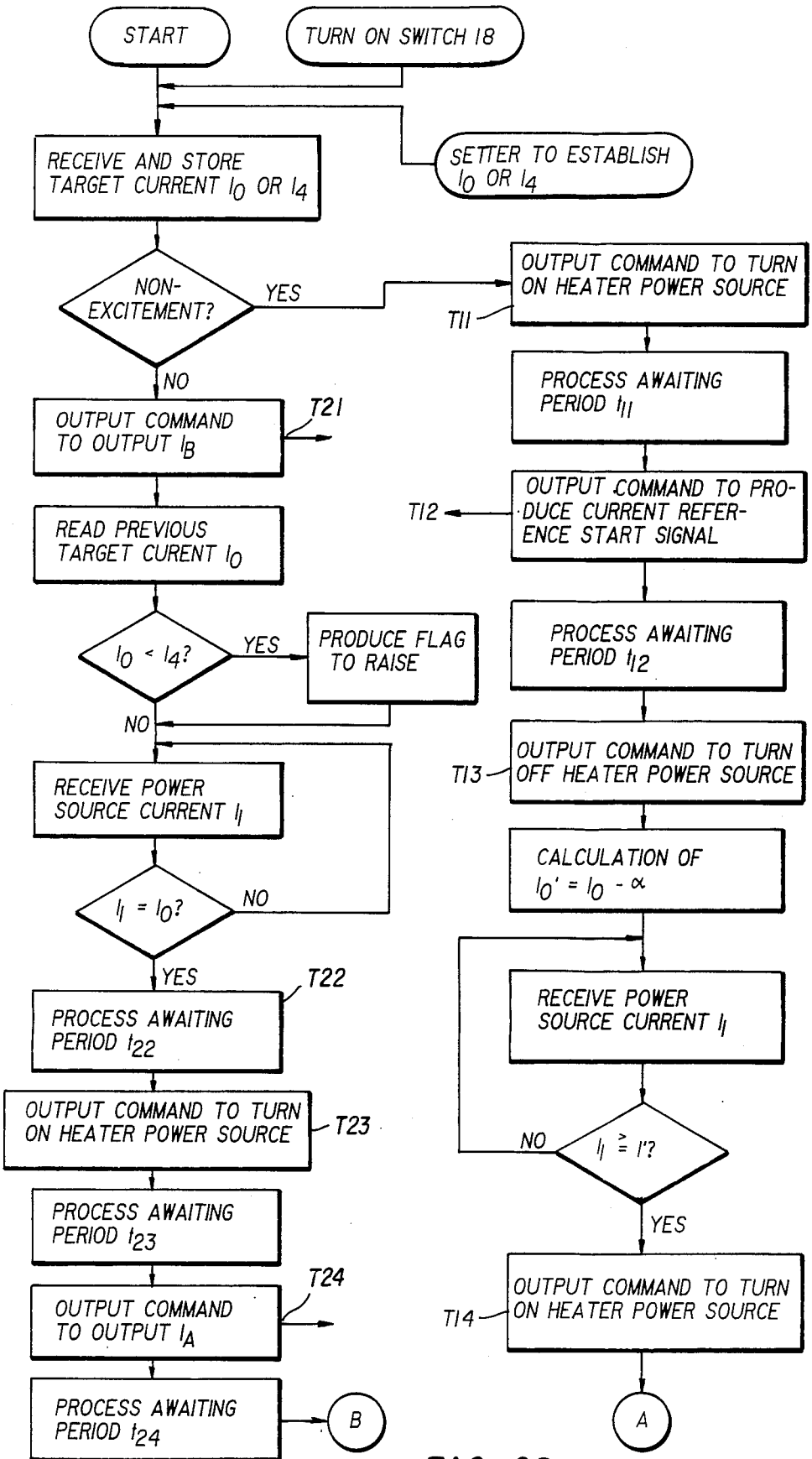
FIG. 2(D), 2(E) and 2(F) are detailed control flow charts of a timing control unit 17 according to the present invention.
Figure 2E:
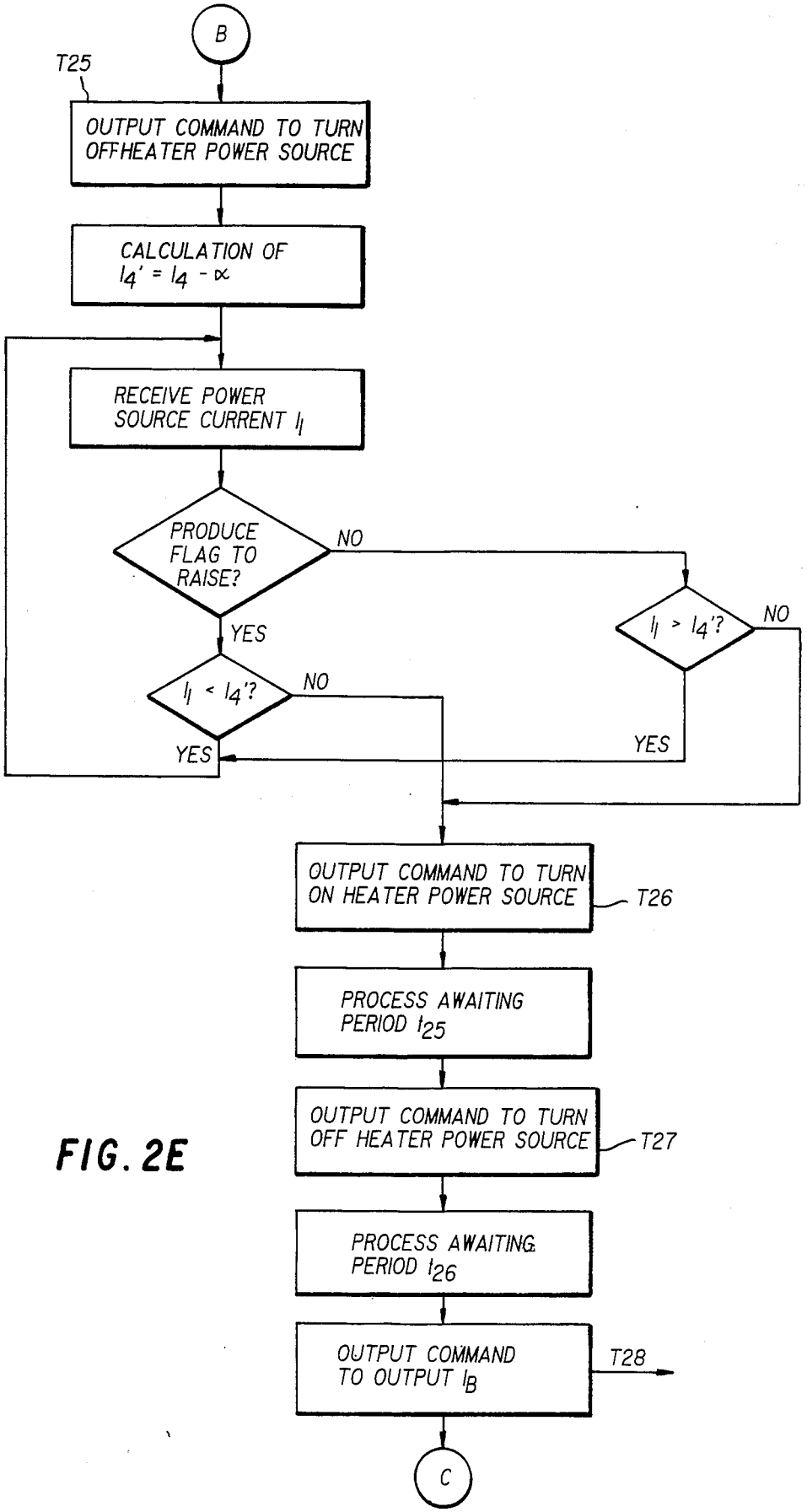
Figure 2F:
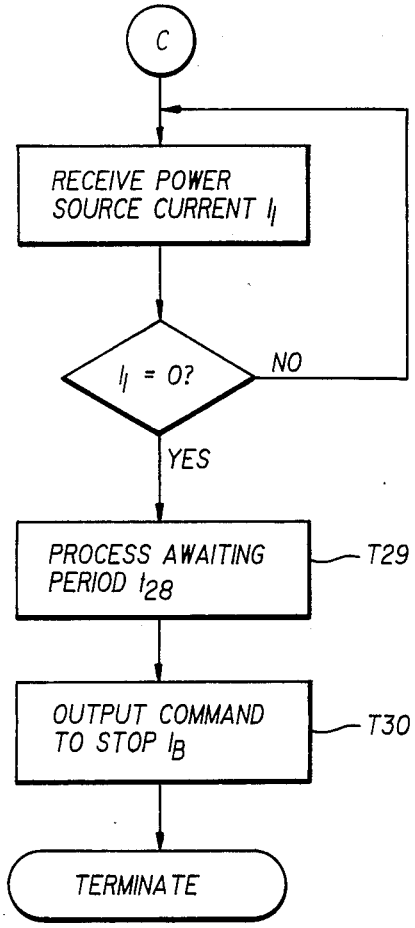
Figure 3:
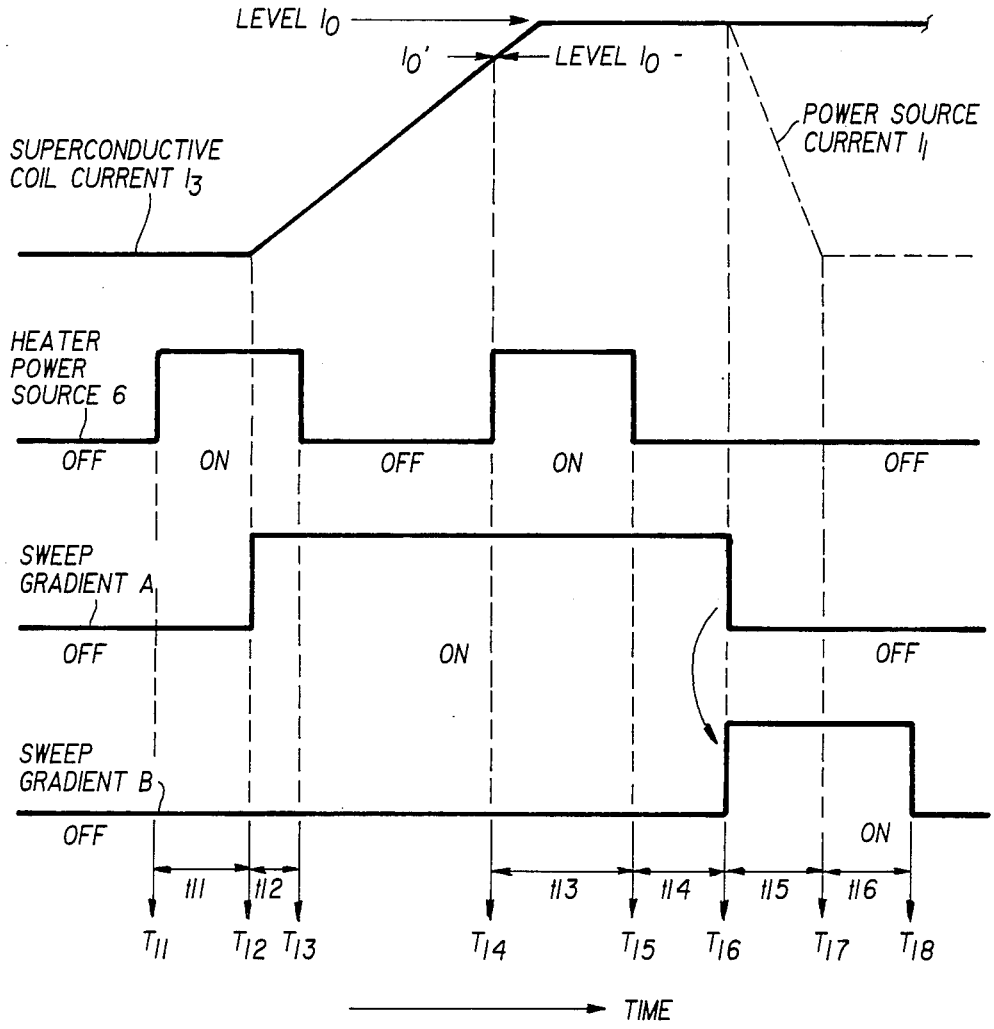
FIG. 3 is a time chart illustrating control operations of one embodiment according to the present invention.

FIGS. 2(A), 2(B) and 2(C) show a detailed control flow chart of the reference generator unit 16, and FIGS. 2(D), 2(E) and 2(F) detailed control flow chart of the timing control unit 17, respectively.

Hereinafter, the description will be made with reference to FIG. 1, FIGS. 2(A)–2(F) and FIG. 3 as to the operations of the above-described configuration during a period from the time at which the superconductive coil 1 is not excited to the time at which a perpetual current loop of a specified current value is created. In this case, the operation mode changeover switch 19 is switched to the side that starts from the non-exciting state.

First, when the operation command switch 18 is turned on, the timing control unit 17 performs such specified procedures as shown in FIGS. 2(D), 2(E) and 2(F), i.e., establishment of the target current $I_0$ or $I_4$ by the target current setter 15, reception and memory of the target current $I_0$ or $I_4$, and discrimination of whether or not there exists non-excitation. Thereafter the timing control unit 17 produces a command that causes the heater power source 6 to be turned on (at a time $T_{11}$ shown in FIG. 3). Next, the timing control unit 17 produces an output command of the current reference $I_A$ with respect to the reference generator 16 at a time $T_{12}$ that comes after a specified period $t_{11}$ which is from the time at which the heater power source 6 is turned on to the time at which the superconductive lead 4 becomes normal-conductive. On the other hand, the reference generator 16 also performs such specified procedures as shown in FIG. 2(A), 2(B) and 2(C), i.e., establishment of the sweep gradient A by the sweep gradient setter 13A, reception and memory of the sweep gradient A, establishment of the sweep gradient B by the setter 13B, reception and memory of the sweep gradient B, establishment of the target current $I_0$ or $I_4$ by the target current setter 15, reception and memory of the target current $I_0$ or $I_4$, and establishment of such conditions as count $N=0$, and $a=A \cdot b=0$ (where b represents a sweep gradient other than the sweep gradients A and B). The current reference $I_A$ is a reference value that causes the DC power source 2 to gradually change the power source current $I_1$ to the target current $I_0$ established by the target current setter 15 in accordance with the current change rate which is the sweep gradient A established previously by the setter 13A. Here, a significant point to be noted is that in accordance with the current reference $I_A$, the superconductive coil current $I_3$ is also changed, so that this change rate is established so as to be a value below the change rate determined by the structure of the superconductive coil 1 thereby to prevent the aforementioned quenching. By virtue of this, the superconductive coil 1 does not become quenching so long as the superconductive coil current $I_3$ is changed in accordance with this current change rate.

The DC power source 2 is controlled such that the power source current $I_1$ is raised at a constant change rate on the basis of the difference signal $\epsilon$ from the adder 12. As a result of this, the DC power source 2 generates a small constant voltage V so as to feed the current $I_3$ to the superconductive coil 1, and the current $I_2$ to the superconductive lead 4, respectively in the same manner as described above. However, according to the present invention, in order to prevent unnecessary evaporation of liquid helium, the heater power source 6 is turned off at a time at which the superconductive lead 4 has become normal-conductive, and thereafter the superconductive lead 4 maintains the normal-conductive state by virtue of self-heating. To achieve this, at a time $T_{13}$ that comes after a waiting period $t_{12}$ which is from the time $T_{11}$ to an instant at which the superconductive lead 4 reaches a point where it is possible to maintain the normal-conductive state, the timing control unit 17 outputs a stop command signal so as to cause the heater power source 6 to be turned off.

On the other hand, the timing control unit 17 receives the target current $I_0$ from the target current setter 15, and detects the fact that the power source current $I_1$ derived from the shunt resistor 10 has reached a current value $I_0'$ which is previously obtained by such a calculation as $I_0-\alpha=I_0'$, i.e., a current value smaller by a specified value $\alpha$ than the target current $I_0$. Upon this detection the timing control unit 17 produces again a start-up command at a time $T_{14}$ with respect to the heater power source 6, which, in turn, is turned on. When the power source current $I_1$ becomes equal to the target current $I_0$, as described above, the superconductive lead current $I_2$ decreases, so that joule heat ($RI_2^2$) generated within the superconductive lead 4 per se becomes insufficient to maintain the normal-conductive state thereof. However, should the heater power source 6 be turned on earlier than the time at which the power source current $I_1$ becomes equal to the target current $I_0$, the normal-conductive state of the superconductive lead 4 can be maintained. Here, R represents the resistance value of the superconductive lead 4 when being in the normal-conductive state. This can realize the condition such that the superconductive coil current $I_3$ equals the target current $I_0$, ($I_3=I_0$).

The timing control unit 17 then produces a command that causes the heater power source 6 to be turned off at a time $T_{15}$ that comes after a period $t_{13}$ which is from the time $T_{14}$ to the time at which the superconductive coil current $I_3$ has assuredly reached the target current $I_0$. When the heater power source 6 is turned off at the time $T_{15}$, the superconductive lead 4 is refrigerated by liquid helium, LHe, (not shown) so as to become superconductive. The period from the time $T_{15}$ to the time at which the superconductive lead 4 becomes superconductive is predetermined by the refrigeration capability of the liquid helium and the thermal capacity of the perpetual switch 3, and this period is a specified period $t_{14}$. The timing control unit 17 produces an output command of the current reference $I_B$ with respect to the reference generator unit 16 after the specified period $t_{14}$ has elapsed from the time at which the heater power source 6 is turned off. The current $I_B$ gradually changes, in accordance with the sweep gradient B established previously by the setter 13B, from the target current $I_0$ established by the setter 15 to a current value of zero. The DC power source 2 which is controlled by the difference output from the adder 12 causes the power source current $I_1$ to be lowered in accordance with the current reference $I_B$ which is gradually decreased. Here, a significant point is in that the sweep gradient B of the current reference $I_B$ is by far greater than the sweep gradient A of the current reference $I_A$, so that the power source current $I_1$ is lowered far faster than that when it is raised. This can be achieved because, as described above, the superconductive coil 1 and the superconductive lead 4 which are the load sides when observed from the DC power source 2 have become the superconductive state of resistance value of zero, in addition, during this period the superconductive coil current $I_3$ does not change but only the superconductive lead current $I_2$ and the power source current $I_1$ change, thus there is no problem even when the power source current is changed with the rapid sweep gradient B. On the other hand, the timing control unit 17 receives the power source current $I_1$ so as to detect a time $T_{17}$ at which the power source current $I_1$ reaches the value of zero. After a specified period $t_{16}$ has elapsed from the time $T_{17}$, i.e., at a time $T_{18}$, the timing control unit 17 produces a stop command of the current reference $I_B$ with respect to the reference generator 16, while at the same time, causes the DC power source 2 to be turned off, and completely terminates a series of control.

Figure 4:
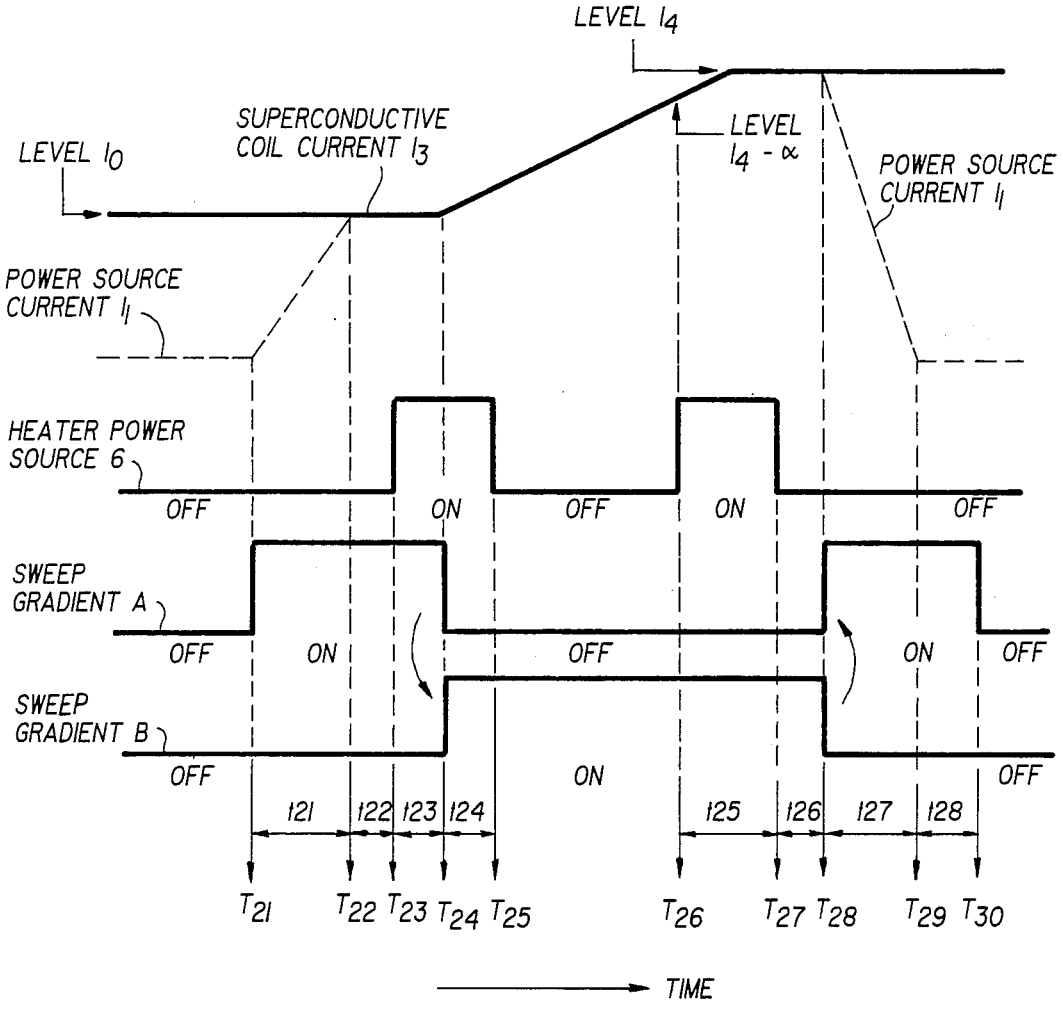
FIG. 4 and FIG. 5 are time charts illustrating control operations of other embodiment according to the present invention.

Hereinafter, another embodiment of the present invention will be described with reference to FIG. 4, where a perpetual current loop state of another specified current $I_4$ is created from the perpetual current loop state of the specified current $I_0$. In this case, the operation mode changeover switch 19 is switched to the side that starts from the exciting state. At this instant, the reference generator 16 stores the target current $I_0$ used in a previous operation, while at the same time, the target current setter 15 establishes another target current $I_4$, which in turn, is fed into the reference generator 16.

First, at a time $T_{21}$, the operation command switch 18 is turned on, and this causes the timing control unit 17 to produce an output command of the current reference $I_B$ with respect to the reference generator unit 16. As described above, the current reference $I_B$ causes the power source current $I_1$ to change gradually, in accordance with the current change rate of the sweep gradient B established previously by the setter 13B, to the target current $I_0$ established in the previous operation by the target current setter 15. Here, a significant point is that the superconductive coil 1 and the superconductive lead 4 which are at the load side when observed from the DC power source 2 have become the perpetual current state that circulates the perpetual current $I_3$ of resistance value of zero, so that the sweep gradient B which is the above-described rapid change rate can be utilized. In accordance with the current reference $I_B$, the DC power source 2 is operated so as to raise the power source current $I_1$ to the target current value $I_0$. At a time $T_{22}$, the timing control unit 17 detects a timing at which the power source current $I_1$ reaches the target current value $I_0$ in the previous operation, and thereafter awaits for a specified period $t_{22}$, then at a time $T_{23}$, produces a command that causes the heater power source 6 to be turned on. After the heater power source 6 has been turned on a specified period $t_{23}$, the superconductive lead 4 becomes normal-conductive so as to possess a resistance R. Then the power source current $I_1$ separates into the superconductive coil current $I_3$ and the perpetual current switch current $I_2$. After the heater power source 6 is turned on, then at a time $T_{24}$ that comes after a specified period $t_{23}$, the timing control unit 17 produces a sweep gradient changeover command to the reference current generator 16 so as to produce the current reference $I_A$. The current reference $I_A$ is a reference value that changes with the sweep gradient A toward the target current $I_4$ established prior to the operation. The DC power source 2 controlled in accordance with the current reference $I_A$ causes the superconductive coil current $I_3$ to be changed. After a sufficient period $t_{24}$ has elapsed, i.e., from the time $T_{24}$ at which the current reference $I_A$ is produced to the time $T_{25}$ at which the superconductive lead 4 assuredly maintains the normal-conductive state thereof, the timing control unit 17 produces a command that causes the heater power source 6 to be turned off. On the other hand, the timing control unit 17 that receives the ultimate target current $I_4$ and the power source current $I_1$ calculates a value smaller by a specified value $\alpha$ than the ultimate target current $I_4$, i.e., $I_4-\alpha=I_4'$, and detects a signal indicative of the power source current $I_1$ having reached the current $I_4'$. According to this signal, at a time $T_{26}$, the timing control unit 17 again produces a command that causes the heater power source 6 to be turned on until the super-conductive coil current $I_3$ equals the ultimate target current $I_4$ in the same manner as described above. Next, at a time $T_{27}$, the heater power source 6 is turned off, and this causes the superconductive lead 4 to become superconductive at a time $T_{28}$ after a specified period $t_{26}$. At the time $T_{28}$, the timing control unit 17 produces the sweep gradient changeover signal that causes the reference current generator unit 16 to switch the current reference $I_A$ to the current reference $I_B$, which changes in accordance with the sweep gradient B to a current value of zero. During this period the superconductive coil current $I_3$ does not change but only the superconductive lead current $I_2$ and the power source current $I_1$ change, so that the power source current $I_1$ can be lowered in accordance with the rapid sweep gradient B. At a time $T_{29}$ at which the power source current $I_1$ reaches the current value of zero, the timing control unit 17 detects this, and at a time $T_{30}$ that comes after a specified period $t_{28}$, produces a stop command of the current reference $I_B$ with respect to the current reference generator unit 16, while at the same time, causes the DC power source 2 to be turned off and completely terminates a series of control.

Moreover, in the above-described operation, although the target current value $I_4$ is established higher than the target current value $I_0$, it can also be established lower than the target current value $I_0$. Further, the target current value $I_4$ can also be established as the value of zero so as to cause the superconductive coil 1 to be in the non-exciting state.

Further, in the above-described embodiment, the superconductive state or the normal-conductive state of the superconductive lead 4 is detected on the basis of the instant at which the specified period has elapsed from the time at which the heater power source 6 is turned on or off. However, should a temperature sensor or the like be disposed in the vicinity of the superconductive lead 4 so as to directly monitor temperatures thereof, the superconductive state or the normal-conductive state thereof can be more assuredly detected. This can more effectively shorten the turn-on period of the heater power source 6, whereby the consumption of liquid helium can be more efficiently suppressed.

Figure 5:
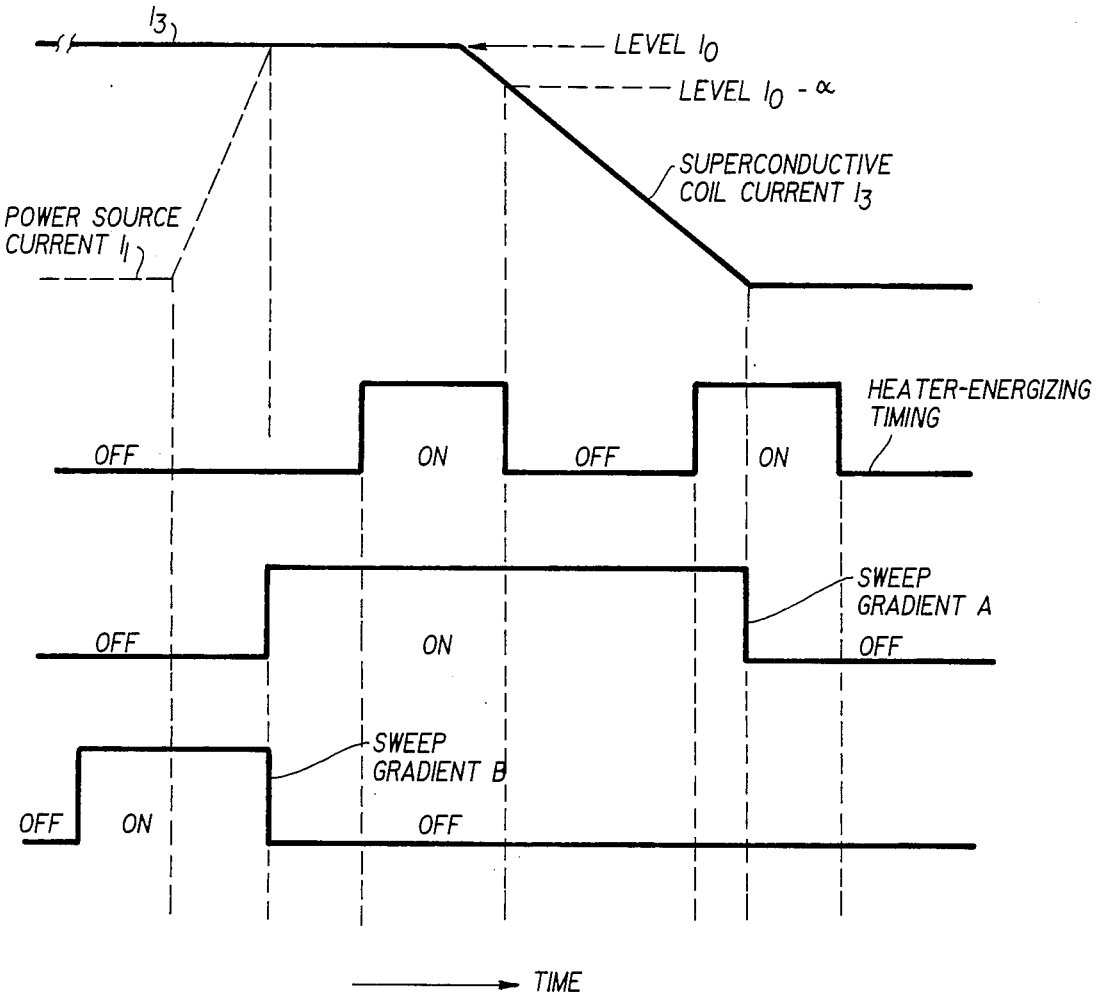
Figure 6:
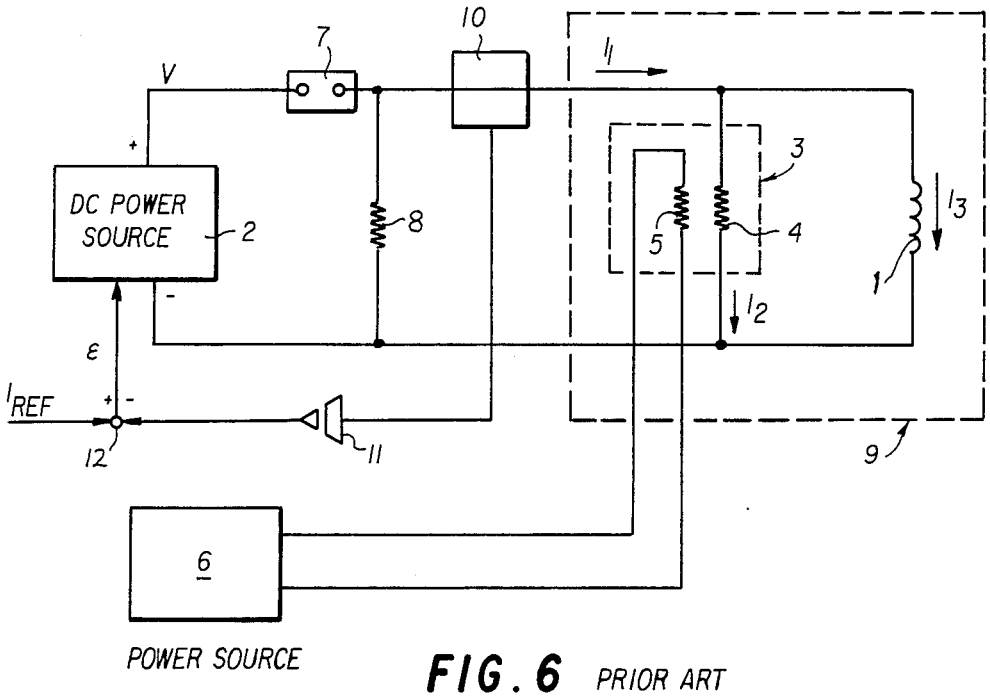
FIG. 6 PRIOR ART
FIG. 6 is a schematic diagram illustrating a configuration of a conventional system.
Figure 7:
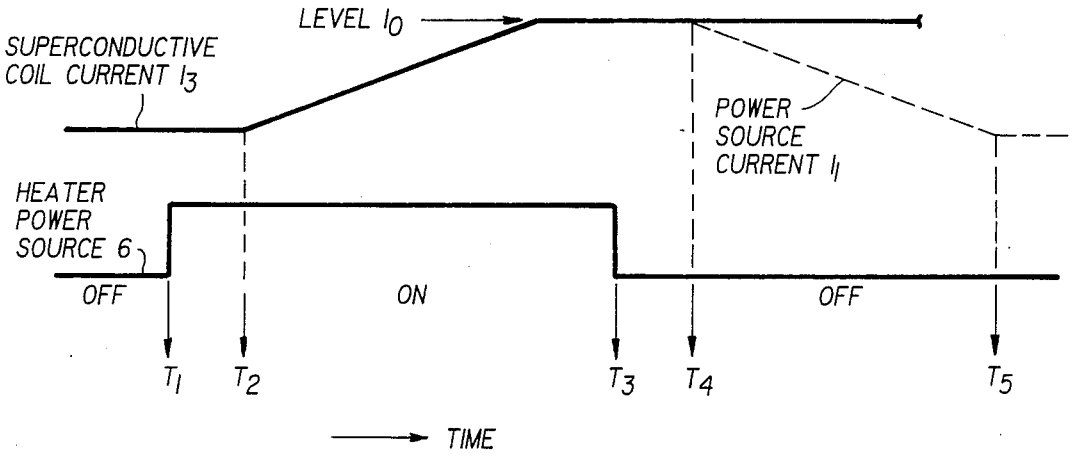
FIG. 7 PRIOR ART
FIG. 7 is a time chart illustrating control operations of the conventional system.

Furthermore, in the above-described embodiment, the description has been made as to the case when the superconductive coil current $I_3$ is raised. However, similar procedures as described above can naturally be performed when $I_3$ is lowered, as shown in FIG. 5.

As described above, according to the present invention, there can be provided a superconducting system including a current reference that changes with a relatively slow sweep gradient so as to change a superconductive coil current, and a current reference that changes with a rapid sweep gradient so as to change a DC power source current and a superconductive lead current while causing no change on the superconductive coil current. By switching these two current references with specified changeover timings, a series of control periods from a time at which a specified perpetual current loop is created to a time at which the DC power source is turned off can be minimized without the disadvantageous occurrence of quenching of the superconductive coil, whereby the diagnostic efficiency of the system can be enhanced.

Moreover, according to the present invention, there can be provided an economical and highly reliable superconducting system such that a superconductive lead within a perpetual current switch is caused to be normal-conductive, and thereafter energized, and during the period in which the superconductive lead can maintain the normal-conductive state thereof by virtue of self-heating, a heater power source is turned off so as to suppress unnecessary heat generation within a cryogenic vessel, so that consumption of expensive liquid helium can be minimized. In addition, the life of the device in the system can be lengthened.

Furthermore, also in the case when the strength of the generated magnetic field of the superconductive coil is changed, for example, the established value of the target current setter is changed from the target current $I_0$ to the target current $I_4$. The procedure causes the reference generator unit and the timing control unit to be operated in the same manner as in the case of the target current $I_0$, whereby there can be provided a highly efficient and economical superconducting system that consumes less liquid helium.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A superconducting system having a perpetual current switch incorporated within a cryogenic vessel and including a superconductive lead connected in parallel with a superconductive coil and a heater disposed in the vicinity of said superconductive lead, said perpetual current switch forming a current loop together with said superconductive coil, a superconductive coil power source installed outside said cryogenic vessel to supply a current to said current loop, and a heater power source that energizes said heater, said system circulating a current of a specified amount into said current loop so as to create a perpetual current loop, said system comprising:

means for establishing sweep gradients, comprising a first current reference with a first sweep gradient that changes a superconducting coil current, and a second current reference with a second sweep gradient that does not change said superconductive coil current but changes currents that flow respectively into said superconductive coil power source and said superconductive lead;

means for establishing a target current that flows through said superconductive coil; and control means for switching said first and second current references with predetermined changeover timings in accordance with desired operation modes of said system.

2. The system according to claim 1, wherein said control means comprises:

means for controlling the current supplied to said current loop such that the supplied current changes at a faster change rate during a time period during which the superconductive coil curent is not changed compared to a time period during which the superconductive coil current is changed.

3. The superconducting system according to claim 2, wherein said control means comprises:

means for controlling operation of said heater power source such that said heater power source is turned on during a specified period in which said power source current is raised or lowered, and during a specified period in which said superconductive coil current has reached a specified current value.

4. The superconducting system according to claim 3, wherein said control means comprises:

means for determining a time at which said heater is again energized as an instant at which said superconductive coil current has become a current of a value smaller by a predetermined value than the target value.

5. The system according to claim 3, wherein said control means comprises:

means for controlling the current supplied to said current loop such that the supplied current changes at a faster change rate during a time period during which the superconductive coil curent is not changed compared to a time period during which the superconductive coil current is changed.

6. The superconducting system according to claim 1, wherein said control means comprises:

a reference generator unit that receives said first current reference, said second current reference and said established target current so as to produce a current reference with respect to said superconductive coil power source; and a timing control unit that receives signals corresponding to said power source current, operation commands and operation mode changeover commands so as to switch operation modes.

7. The superconducting system according to claim 6, wherein said means for establishing said target current establishes a target value of said superconductive coil current as a value of zero.

8. The superconducting system according to claim 6, wherein said means for establishing said target current establishes a target value of said superconductive coil current as a value other than zero.

9. The system according to claim 6, wherein said control means comprises:

means for controlling the current supplied to said current loop such that the supplied current changes at a faster change rate during a time period during which the superconductive coil curent is not changed compared to a time period during which the superconductive coil current is changed.

10. A method for controlling a superconducting system having a perpetual current switch incorporated within a cryogenic vessel and including a superconductive lead connected in parallel with a superconductive coil and a heater disposed in the vicinity of said superconductive lead, said perpetual current switch forming a current loop together with said superconductive coil, a superconductive coil power source installed outside said cryogenic vessel to supply a current to said current loop, and a heater power source that energizes said heater, said system circulating a current of a specified amount into said current loop so as to create a perpetual current loop, said method comprising the steps of:

maintaining said superconductive coil superconductive when said superconductive coil was previously superconductive when raising a superconductive coil current to be fed into said superconductive coil;

simultaneously energizing said heater so as to cause said superconductive lead to be normal-conductive;

thereafter controlling the output current of said superconductive coil power source such that said superconductive coil current is increased to an ultimate target value at such a current increase rate that quenching failure never occurs in said superconductive coil;

de-energizing said heater during the period in which said superconductive lead can maintain the normal-conductive state per se by virtue of joule selfheating in the process of increasing said superconductive coil current;

energizing again said heater only during a desired period calculated from a specified time constant $\tau = L/R$, where L represents the inductance of said superconductive coil and R represents the resistance of said superconductive lead, before and after a time at which said superconductive coil current reaches said ultimate target value;

decreasing said power source current to a value of zero at such a current decrease rate that quenching failure never occurs in said superconductive lead after a time at which the output current of said superconductive coil power source has become equal to said superconductive coil current; and causing the operation of said superconductive coil power source to be stopped.

11. The method for controlling said superconducting system according to claim 10, comprising:

determining a time at which said heater is again energized as an instant at which said superconductive coil current has become a current of a value smaller by a predetermined value than said ultimate target value.

12. The method for controlling said superconducting system according to claim 10, wherein during the period in which said superconductive coil current is not changed but only said power source current is changed, current is controlled at faster change rate compared to during the period in which said superconductive coil current is changed.

13. A method for controlling a superconducting system having a perpetual current switch incorporated within a cryogenic vessel and including a superconductive lead connected in parallel with a superconductive coil and a heater disposed in the vicinity of said superconductive lead, said perpetual current switch forming a current loop together with said superconductive coil, a superconductive coil power source installed outside said cryogenic vessel to supply a current to said current loop, and heater power source the energizes said heater, said system circulating a current of a specified amount into said current loop so as to create a perpetual current loop, said method comprising the steps of:

causing said power source current to be equal to said superconductive coil current in quantity when raising a superconductive coil current which has been already fed into said superconductive coil;

thereafter energizing said heater so as to cause said superconductive lead to be normal-conductive;

thereafter controlling the output current of said superconductive coil power source such that said superconductive coil current is increased to an ultimate target value at such a current increase rate that quenching failure never occurs in said superconductive coil;

de-energizing said heater during a period in which said superconductive lead can maintain the normal-conductive state per se by virtue of joule self-heating in the process of increasing said superconductive coil current;

energizing again said heater only during a desired period calculated from a specified time constant $\tau = L/R$, where L represents the inductance of said superconductive coil and R represents the resistance of said superconductive lead, before and after a time at which said superconductive coil current reaches said ultimate target value;

decreasing said power source current to a value of zero at such a current decrease rate that quenching failure never occurs in said superconductive lead after a time at which the output current of said superconductive coil power source has become equal to said superconductive coil current; and causing the operation of said superconductive coil power source to be stopped.

14. The method for controlling said superconducting system according to claim 13, wherein during the period in which said superconductive coil current is not changed but only said power source current is changed, current is controlled at faster change rate compared to during the period in which said superconductive coil current is changed.

15. A method for controlling a superconducting system having a perpetual current switch incorporated within a cryogenic vessel and including a superconductive lead connected in parallel with a superconductive coil and a heater disposed in the vicinity of said superconductive lead, said perpetual current switch forming a current loop together with said superconductive coil, a superconductive coil power source installed outside said cryogenic vessel to supply a current to said current loop, and a heater power source that energizes said heater, said system circulating a current of a specified amount into said current loop so as to create a perpetual current loop, said method comprising the steps of:

causing said power source current to be equal to said superconductive coil current when lowering said superconductive coil current which has been already fed into said superconductive coil;

thereafter energizing said heater so as to cause said superconductive lead to be normal-conductive;

thereafter controlling the output current of said superconductive coil power source such that said superconductive coil current is decreased to an ultimate target value at such a current decrease rate that quenching failure never occurs in said superconductive coil;

de-energizing said heater during a period in which said superconductive lead can maintain the normal-conductive state per se by virtue of joule self-heating in the process of decreasing said superconductive coil current;

energizing said heater again only during a desired period calculated from a specified time constant $\tau = L/R$, where L represents the inductance of said superconductive coil and R represents the resistance of said superconductive lead, before and after a time at which said superconductive coil current reaches said ultimate target value;

decreasing said power course current to a value of zero at such a current decrease rate that quenching failure never occurs in said superconductive lead after a time at which the output current of said superconductive coil power source has become equal to said superconductive coil current; and causing the operation of said superconductive coil power source to be stopped.

16. The method for controlling said superconductive system according to claim 15, wherein during the period in which said superconductive coil current is not changed, but only said power source current is changed, current is controlled at a faster change rate compared to during the period in which said superconductive coil current is changed.

* * * * *